United States Patent [19]

Newell

[11] 4,050,773

[45] Sept. 27, 1977

[54] BATTERY TERMINAL CONNECTOR

[76] Inventor: Carl W. Newell, 940 Allen Ave., Glendale, Calif. 91201

[21] Appl. No.: 670,086

[22] Filed: Mar. 24, 1976

[51] Int. Cl.[2] ..... H01R 11/20; H01R 11/26

[52] U.S. Cl. ..... 339/224; 339/100

[58] Field of Search ..... 339/100, 224, 231, 263 R, 339/263 B, 268 R

[56] References Cited

U.S. PATENT DOCUMENTS

| | | | |
|---|---|---|---|
| 2,009,090 | 7/1935 | Little | 339/268 R X |
| 2,852,596 | 9/1958 | Prince | 339/263 R X |
| 3,317,883 | 5/1967 | Gourley et al. | 339/100 X |
| 3,377,609 | 4/1968 | Shannon et al. | 339/224 X |

FOREIGN PATENT DOCUMENTS

| | | | |
|---|---|---|---|
| 612,213 | 11/1948 | United Kingdom | 339/100 |

*Primary Examiner*—Roy Lake
*Assistant Examiner*—E. F. Desmond
*Attorney, Agent, or Firm*—Lyon & Lyon

[57] ABSTRACT

Disclosed herein is an electrical terminal connector assembly particularly adapted for use with automotive batteries for eliminating the corrosion at the battery terminals. The assembly includes a non-corrosive coupling adapted to be secured to a battery terminal, an electrical cable extending therefrom and a connector for communicating the cable with the existing automotive ground or hot lead. The connector is comprised of a double-ended threaded fastening member constructed of an electrically conductive material disposed within a sheath of insulating material. One end of the fastening member is in threaded engagement with the extended end of the electrical cable and the other end is adapted for threaded engagement with one of the aforesaid existing electrical leads.

3 Claims, 4 Drawing Figures

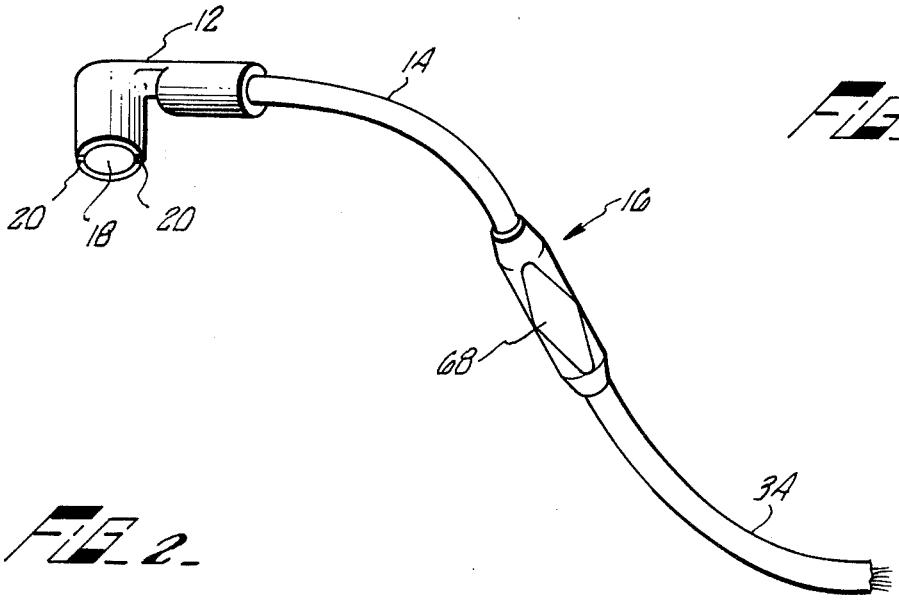
FIG. 1
FIG. 2
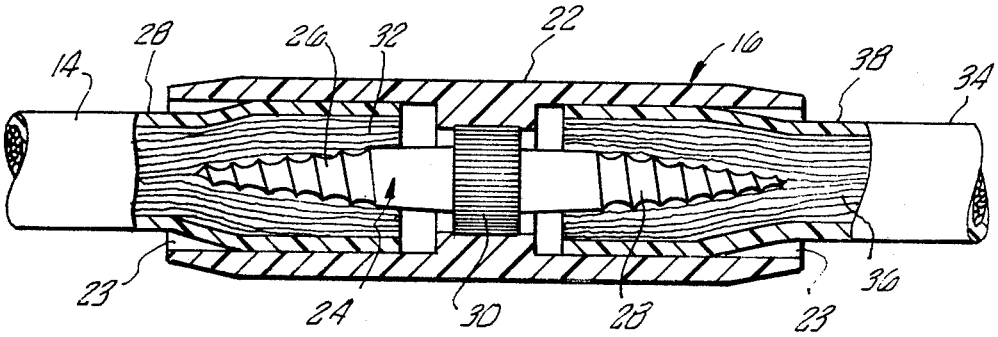
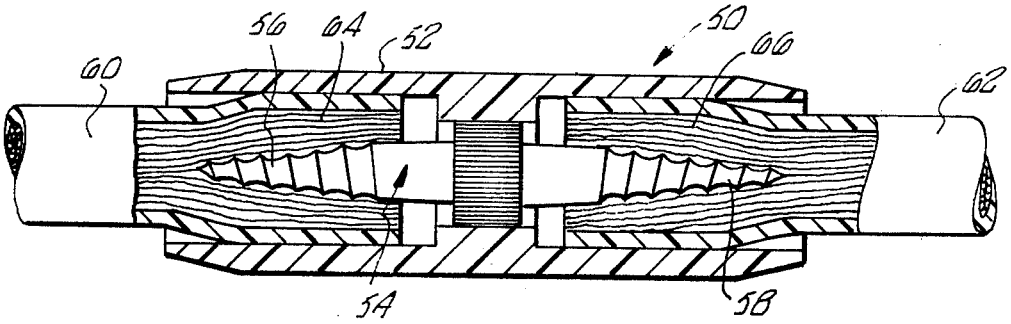
FIG. 3
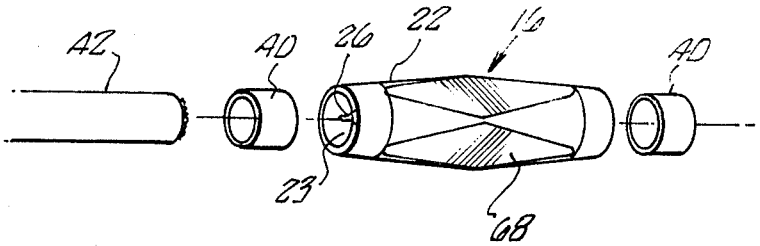
FIG. 4

BATTERY TERMINAL CONNECTOR

BACKGROUND OF THE INVENTION

The connecting mechanisms which are used to connect the ground and hot leads to the battery in an automobile have been generally standardized for years and the problem which consistently plagues such connections in one of corrosion. Corrosion results from the acid used in such batteries acting on the metal of which these standard connectors are constructed. An inert metal such a lead which would eliminate this problem has not been widely employed in connecting mechanisms due to its lack of memory, i.e., once deformed it will retain its deformed state after the pressure causing such deformation has been relieved. When lead is used in the standard threaded connecting mechanism, once the pressure exerted by the tightening screw is relieved, the connector still has to be forcibly removed from the battery terminal. Accordingly, inert metals such as lead have often been avoided in the past. Nevertheless, given the proper construction of a lead coupling, such a device would certainly be preferable over the standard metal connecting mechanisms as the corrosion on the terminals with its obvious deleterious effects would be eliminated.

Despite the development of an improved lead coupling, a problem remains of how to economically equip the existing automobilies' hot and ground leads with such a new coupling in place of corrosion susceptible couplings. Simply to remove the existing connecting mechanisms and replace them with a lead coupling would require special equipment and know-how not generally possessed by most automobile owners and the inconvenience and expense of having such a conversion made in an automobile garage would most likely outweigh the benefits to be obtained by the new coupling in the eyes of most automobile owners. It would be highly desirable to provide an assembly by which old battery coupling could be easily replaced with an improved lead coupling by a person of average mechanical ability without the need for specialized equipment. Such an assembly has been developed and is described below.

SUMMARY OF THE INVENTION

Briefly, the invention comprises a terminal connecting assembly for replacing existing mechanisms for securing the ground and hot leads to the terminals of an automotive battery. The assembly includes a non-corrosive coupling adapted to be secured to one of the terminals of the battery, an electrical cable extending therefrom and a connector secured to the extended end of the cable for electrically communicating the cable and coupling with an extended end of one of the existing ground or hot leads.

It is the principal object of the present invention to provide an assembly for economically and simplistically replacing the standard connecting mechanisms for securing the ground and hot leads of an automobile with non corrosive lead couplings.

It is another object of the present invention to provide a connecting mechanism for splicing together lengths of electric cable.

It is a still further object of the present invention to provide a connecting mechanism for splicing together length of electrical cable which is of simple construction and economical to manufacture.

It is yet another object of the present invention to provide a connecting mechanism for splicing together lengths of electric cable which can be easily operated without the need of specialized tooling.

It is still a further object of the present invention to provide an assembly for replacing the standard connecting mechanisms for securing the ground and hot leads of an automobile to its battery with a non-corrosive lead coupling which can be easily installed without the need for specialized equipment.

BRIEF DESCRIPTION OF THE DRAWINGS

FIG. 1 is a perspective view of the terminal connecting assembly.

FIG. 2 is a sectional view of the connector maintaining two cables in electrial communication.

FIG. 3 illustrates a second embodiment of the invention particularly adapted for splicing together electrical cables.

FIG. 4 is an exploded view of the connector illustrating the incorporation of insulating rings for use with cables of smaller diameter.

Referring now in detail to the drawings; one embodiment of the invention is illustrated in FIGS. 1 - 3. As seen in FIG. 1, the electrical terminal connector assembly 10 is comprised of a non-corrosive coupling 12, an electrical cable 14 and a connector 16. The coupler 12 is preferably constructed of lead; is secured to the electrical cable 14 by a standard press fit; is provided with a recessed area 18 adapted to receive a terminal of the automobile battery bracket (not shown); and is provided with a transverse slot 20 allowing the coupling to be deformed about the terminal by any conventional tightening mechanism.

The connecting assembly 16, as shown in FIG. 2, is comprised of an outer-insulated jacket or housing 22 and a double ended threaded fastening member 24, disposed within the housing or jacket. The fastening member is comprised of a pair of screw portions 26 and 28 joined by a central enlarged head portion 30. In this embodiment of the invention, screw portions 26 and 28 are threaded in the same direction for reasons which will become apparent.

The leaded coupling 12 has been previously secured to one end of the short length of cable 14 and the connector 16 has been secured to the other end. The connector 16 is secured by disposing the end of screw member 26 against the extended ends of the wires 32 comprising cable 14 and rotating the connector assembly 16 and accordingly screw member 26 with respect to the wires 32, thereby causing the screw member to thread its way between the wires and form a strong electrical connection between the cable and connector assembly 16. The electrical terminal connector assembly 10, having been preassembled in this manner, is connected to either the hot or ground automotive leads by means of simply severing the conventional mechanism (not shown) for connecting one of such leads to the automotive battery terminal to define an extended lead 34. The extended end of screw member 28 is then disposed against the severed ends of wires 36 which comprise cable 34 and the connector 16 is rotated with respect thereto as in constructing the terminal connector assembly 10 causing screw member 28 to thread its way between the wires 36. Both in constructing the terminal connector assembly 10 and in securing that assembly to the severed cable 34, the wires 32 and 36 comprising the cables are held tightly about the extended screw members 26 and 28 by the covering insulating material 38 which is conventionally wrapped tightly about the inner cable wires. Having secured the assembly 10 to the severed end of cable 34, it is only necessary to dispose the non-corrosive lead coupling 12 over the exposed battery terminal (not shown) and deform the coupling about the terminal and transverse slot 20 with the use of a conventional tightening tool. In this manner the standard connecting mechanism which was previously employed on the ground and hot leads to the battery and which is continually subjected to deleterious corrosion can be easily replaced with a non-corrosive coupling 12.

In FIG. 4, the connector assembly 16 is seen to include an insulated sizing ring 40 to allow the connector assembly to accomodate cables 42 of smaller diameter. The sizing ring 40 merely fits within the open end 23 of the housing 22, thereby reducing the diameter of such open ends to provide a secure fit between the coupling 16 and cable 42.

A second embodiment of the invention is illustrated in FIG. 3. This embodiment is comprised solely of a connector assembly 50 which, while adaptable for use in the electrical terminal connector assembly 10, is particularly suited for use in splicing together lengths of electrical cable wherein both ends of the cable are secured. Connector 50 is quite similar to connector 16 in that it includes an insulated housing 52 and double ended threaded fastening member 54. However, unlike the double ended fastening member 24 used in connector 16, fastening member 54 is comprised of two screw member portions 56 and 58 which are threaded in opposite directions. Accordingly, the extended ends of the screw members can be concurrently disposed against the severed ends of cables 60 and 62 and rotated with respect thereto causing each of the screw members to concurrently thread themselves between the wires 64 and 66 of the respective cables 60 and 62. In this manner two electrical cables can be readily joined in a secure electric coupling. The coupling 50 can also be provided with insulated and sizing rings 40 at the open end thereof to accomodate cables of varying size as described above and also provide additional insulation when deemed necessary. It can be seen that if connector 50 were provided with screw member portions having the same threaded direction as connector 16, the connector could not concurrently affix itself to two cables as one of the screw members would tend to back away from one of the cables while the other member was threading its way into a secured position. With the prior embodiment, it is only necessary to secure the connector 16 to one cable at a time as the two steps are not carried out concurrently.

To facilitate the rotation of connector 16 or 50 in splicing together lengths of electrical cable, flattened gripping surfaces 68 (see FIGS. 1 and 4) have been provided on the exterior of the insulated housing which is held to the fastening members 24 and 54 by a pressure bit about the enlarged head portions 30.

Various changes and embodiments may be made in carrying out the present invention without departing from the spirit and scope thereof. Insofar as these changes and modifications are within the purview of the appended claims they are to be considered as part of the invention.

I claim:

1. A connector assembly for providing a non-corrosive coupler for a battery cable, said assembly comprising a coupling member constructed of a lead alloy and being adapted to be secured to a battery terminal, an electrical cable, one end of said battery cable being secured to said coupling member, and a connector assembly for securing and electrically communicating said electrical cable to said battery cable, said assembly being comprised of a threaded contact member constructed of an electrically conductive material and a rigid housing constructed of an insulating material and disposed about said threaded contact member, said contact member having a pair of threaded screw portions extending along a common longitudinal axis in opposite directions from a common head portion, one of said screw portions being in threaded engagement with the wires comprising said cable and the other of said portions being adapted for threaded engagement with the wires comprising said battery cable whereby said cable and said battery cable can be held in electrical communication by said screw portions of said contact member.

2. The combination of claim 1 wherein said oppositely extending screw portions of said connector assembly are threaded in the same direction.

3. A connector assembly for providing a non-corrosive coupler for a battery cable, said assembly comprising a coupling member adapted to be secured to a battery terminal, said member being constructed of electrically conductive, corrosion resistant material; an electrical cable, one end of said cable being secured to said coupling member; and a connector assembly for securing and electrically communicating said cable to said battery cable, said assembly being comprised of a threaded contact member constructed of an electrically conductive material and a rigid housing constructed of an insulating material and disposed about said threaded contact member, said contact member being carried by and in electrical communication with said cable and having a threaded screw portion extending therefrom in axial alignment with said cable and being adapted for threaded engagement with the wires comprising said battery cable whereby said cable and said battery cable can be held in electrical communication by said screw portion of said contact member.

* * * * *